US009873538B2

(12) United States Patent
Yokota et al.

(10) Patent No.: US 9,873,538 B2
(45) Date of Patent: Jan. 23, 2018

(54) POLYGONAL BOTTLE

(71) Applicants: Norio Yokota, Matsudo (JP); Takashi Harada, Matsudo (JP)

(72) Inventors: Norio Yokota, Matsudo (JP); Takashi Harada, Matsudo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 15/333,883

(22) Filed: Oct. 25, 2016

(65) Prior Publication Data

US 2017/0152071 A1 Jun. 1, 2017

(30) Foreign Application Priority Data

Nov. 30, 2015 (JP) ..... 2015-234175

(51) Int. Cl.
*B65D 1/02* (2006.01)
*B65D 1/42* (2006.01)
*B65D 79/00* (2006.01)

(52) U.S. Cl.
CPC ..... *B65D 1/0223* (2013.01); *B65D 1/0207* (2013.01); *B65D 1/0246* (2013.01); *B65D 1/0276* (2013.01); *B65D 1/42* (2013.01); *B65D 79/005* (2013.01)

(58) Field of Classification Search
CPC ..... B65D 1/0223; B65D 1/02; B65D 1/0207; B65D 1/0246; B65D 1/0276; B65D 1/42
USPC ..... 215/373, 372, 371, 370, 384, 383, 382, 215/379, 44; 220/608, 604, 623, 610, 220/669, 675; D9/560, 559, 530, 566, D9/573, 572
See application file for complete search history.

(56) References Cited

U.S. PATENT DOCUMENTS 4,308,955 A * 1/1982 Schieser ..... B65D 1/0223 206/509
5,238,129 A * 8/1993 Ota ..... B65D 1/0223 215/381
5,381,910 A * 1/1995 Sugiura ..... B65D 1/0223 215/374

(Continued)

FOREIGN PATENT DOCUMENTS

JP 2003165522 A * 6/2003 ..... B65D 1/09
JP 2004-131176 A 4/2004

*Primary Examiner* — Robert J Hicks
(74) *Attorney, Agent, or Firm* — Oliff PLC

(57) ABSTRACT

A polygonal bottle, and mouth, shoulder, drum, and bottom sections are formed in a bottle axial direction, the drum section including main wall sections connected via connecting sections in a circumferential direction about a bottle axis, in a lateral cross sectional view perpendicular thereto, a polygonal shape is formed, in which a panel section recessed inward in a radial direction, extending in the bottle axial direction and arriving at an upper portion of the mouth section side of the main wall section formed at the main wall sections of the drum section. A reinforcement protrusion protruding outward in the radial direction is formed at shoulder section connecting portions, a top surface directed outward in the radial direction is continued to an outer circumferential surface of the drum section with no step difference, and an upper surface directed upward is formed in a curved surface shape protruding upward.

4 Claims, 2 Drawing Sheets

(56) References Cited

U.S. PATENT DOCUMENTS

| | | | | |
|---|---|---|---|---|
| 5,971,184 | A * | 10/1999 | Krishnakumar | B65D 23/102<br>215/379 |
| 2008/0000867 | A1 * | 1/2008 | Lane | B65D 1/0223<br>215/10 |
| 2009/0057263 | A1 * | 3/2009 | Barker | B65D 79/005<br>215/381 |

* cited by examiner

POLYGONAL BOTTLE

BACKGROUND OF THE INVENTION

Field of the Invention

The present invention relates to a polygonal bottle.

Priority is claimed on Japanese Patent Application No. 2015-234175, filed Nov. 30, 2015, the content of which is incorporated herein by reference.

Description of Related Art

In the related art, for example, as disclosed in Japanese Unexamined Patent Application, First Publication No. 2004-131176, there is known a polygonal bottle in which a mouth section, a shoulder section, a drum section and a bottom section are sequentially and continuously formed in a bottle axial direction and integrally formed of a synthetic resin material, the drum section includes a plurality of main wall sections connected via connecting sections in a circumferential direction about a bottle axis such that in a lateral cross-sectional view perpendicular to the bottle axis, a polygonal shape is formed, and a panel section recessed inward in a radial direction, extending in the bottle axial direction and arriving at an upper portion of the mouth section side of the main wall section is formed at the main wall sections of the drum section.

However, in such a polygonal bottle, when a plurality of bottles are conveyed in a state in which the bottles are continuously stood, for example, before contents are filled, or the like, as a large compressive force is applied to the upper end portion of the main wall section of the drum section of the bottle inward in the radial direction, depression deformation may occur from the upper end portion to the shoulder section.

In consideration of the above-mentioned problems, the present invention is directed to provide the polygonal bottle capable of limiting occurrence of depression deformation from the upper end portion of the main wall section of the drum section to the shoulder section even when a large compressive force inward in the radial direction is received at the upper end portion in the bottle upon conveyance.

SUMMARY OF THE INVENTION

In order to solve the above-mentioned problems, a polygonal bottle according to the present invention has a mouth section, a shoulder section, a drum section and a bottom section that are sequentially and continuously formed in a bottle axial direction and integrally formed of a synthetic resin material, the drum section including a plurality of main wall sections connected via connecting sections in a circumferential direction about a bottle axis such that in a lateral cross sectional view perpendicular to the bottle axis, a polygonal shape is formed, and in which a panel section recessed inward in a radial direction, extending in the bottle axial direction and arriving at an upper portion of the mouth section side of the main wall section is formed at the main wall sections of the drum section, wherein a reinforcement protrusion protruding outward in the radial direction is formed at connecting portions of the shoulder section to the main wall sections of the drum section, among surfaces of the reinforcement protrusion, a top surface directed outward in the radial direction is continued to an outer circumferential surface of the drum section with no step difference, and an upper surface directed upward is formed in a curved surface shape protruding upward.

According to the present invention, since the top surface of the reinforcement protrusion formed at the connecting portion of the shoulder section is continued to the outer circumferential surface of the drum section with no step difference, a compressive force applied to the upper end portion disposed over the panel section in the main wall sections of the drum section (hereinafter, simply referred to as a compressive force) can also be received by the reinforcement protrusion, and it can be limited that a local large compressive force is applied to the upper end portion of the main wall section of the drum section.

Moreover, the upper surface of the reinforcement protrusion can serve as a rib with respect to the compressive force, and the upper surface is formed in a curved surface shape protruding upward. Accordingly, an area of the top surface of the reinforcement protrusion can be widely secured, and the compressive force can be easily distributed in the circumferential direction.

As described above, generation of depression deformation from the upper end portion of the main wall section of the drum section to the shoulder section by the compressive force applied to the upper end portion can be limited.

The panel section is formed in a rectangular shape extending in the bottle axial direction in a front view when seen from the outside in the radial direction, in the front view, an outer circumferential edge of the panel section includes a pair of lateral edge portions extending in the circumferential direction and disposed at an interval in the bottle axial direction, a pair of vertical edge portions extending in the bottle axial direction and disposed at an interval in the circumferential direction, and corner edge portions that connect the lateral edge portions and the vertical edge portions and form a curved line protruding outward, and both end portions in the circumferential direction of the reinforcement protrusion are disposed farther outside in the circumferential direction than both end portions in the circumferential direction of the lateral edge portions.

According to the present invention, since both end portions in the circumferential direction of the reinforcement protrusion are disposed farther outside in the circumferential direction than both end portions in the circumferential direction of the lateral edge portions, generation of depression deformation from the upper end portion of the main wall section of the drum section to the shoulder section by the compressive force applied to the upper end portion can be securely limited.

A surrounding groove that surrounds an upper end portion of the panel section is formed at the main wall section of the drum section, and both end portions in the circumferential direction of the surrounding groove are disposed farther outside in the circumferential direction than both end portions in the circumferential direction of the reinforcement protrusion.

According to the present invention, since the surrounding groove that surrounds the upper end portion of the panel section is formed at the main wall section of the drum section, stiffness of the upper end portion in the main wall section of the drum section can be increased, and generation of depression deformation from the upper end portion to the shoulder section by a compressive force applied to the upper end portion can be more securely limited.

DETAILED DESCRIPTION OF THE INVENTION

Hereinafter, an embodiment of a polygonal bottle according to the present invention will be described with reference to FIGS. 1 and 2.

Figure 1:
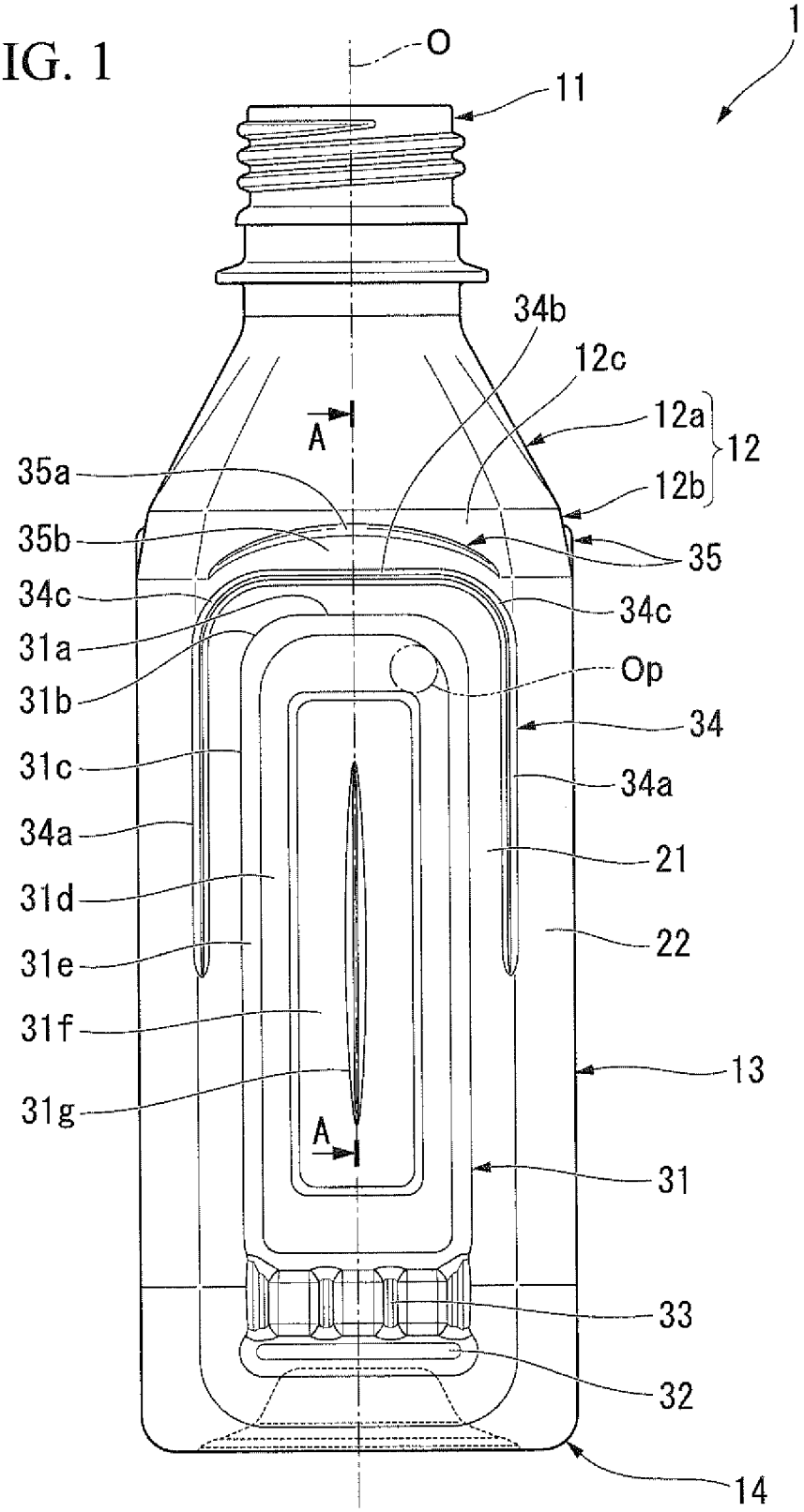
FIG. 1 is a front view of a polygonal bottle shown as an embodiment according to the present invention.

A polygonal bottle 1 according to the embodiment is integrally formed of a synthetic resin, schematically constituted by a mouth section 11, a shoulder section 12, a drum section 13 and a bottom section 14 that are sequentially and continuously formed in a bottle axis O direction as shown in FIG. 1, and formed through blow molding. The mouth section 11, the shoulder section 12, the drum section 13 and the bottom section 14 are disposed coaxially with the bottle axis O.

Hereinafter, the mouth section 11 side in the bottle axis O direction is referred to as an upper side and the bottom section 14 side is referred to as a lower side, and in a plan view when seen in the bottle axis O direction, a direction around the bottle axis O is referred to as a circumferential direction and a direction perpendicular to the bottle axis O is referred to as a radial direction.

As shown in FIG. 1, the shoulder section 12 connects the mouth section 11 and the drum section 13 in the bottle axis O direction, and has a diameter gradually reduced from the lower side toward the upper side. In addition, the shoulder section 12 includes a shoulder section main body 12*a* extending downward from a lower end of the mouth section 11, and a connecting section 12*b* extending upward from an upper end of the drum section 13. An inclination angle of the connecting section 12*b* with respect to the bottle axis O is smaller than an inclination angle of the shoulder section main body 12*a* with respect to the bottle axis O.

The drum section 13 has a polygonal shape in which a plurality of main wall sections 21 are connected in the circumferential direction via connecting sections 22, and in a lateral cross-sectional view perpendicular to the bottle axis O, the main wall sections 21 form edge portions and the connecting sections 22 form corner portions. Further, the number of main wall sections 21 provided is an even number. In an example shown, the drum section 13 forms a substantially square shape when seen in a lateral cross-sectional view perpendicular to the bottle axis O.

Panel sections 31 for pressure reduction and absorption that are recessed inward in the radial direction through the entire region except for the outer circumferential portion are formed at the main wall sections 21 of the drum section 13. Each of the panel sections 31 has a rectangular shape extending in the bottle axis O direction in a front view when seen from the outside in the radial direction. An outer circumferential edge of the panel section 31 includes a pair of lateral edge portions 31*a* extending in the circumferential direction and disposed at an interval in the bottle axis O direction, a pair of vertical edge portions 31*c* extending in the bottle axis O direction and disposed at an interval in the circumferential direction, and corner edge portions 31*b* connecting the lateral edge portions 31*a* and the vertical edge portions 31*c* and having curved lines protruding outward. In addition, a central section in the circumferential direction of the panel section 31 and a central section in the circumferential direction of the main wall section 21 coincide with each other.

The panel section 31 includes a panel bottom wall section 31*d* disposed inside in the radial direction with respect to an outer circumferential surface of the main wall section 21, and a panel sidewall section 31*e* extending from an outer circumferential edge of the panel bottom wall section 31*d* outward in the radial direction. Further, the panel section 31 is disposed inside in the bottle axis O direction and the circumferential direction with respect to an outer circumferential edge of the main wall section 21. A protrusion base section 31*f* protruding outward in the radial direction is formed at the panel bottom wall section 31*d*. The protrusion base section 31*f* is formed throughout the panel bottom wall section 31*d* except for the outer circumferential portion. When seen in the front view, the central section of the panel section 31 and the central section of the protrusion base section 31*f* coincide with each other. An outer end surface in the radial direction of the protrusion base section 31*f* is disposed further inside in the radial direction than the outer circumferential surface of the main wall section 21.

In addition, a longitudinal stripe groove 31*g* extending in the bottle axis O direction is formed at a center in the circumferential direction of the protrusion base section 31*f*.

Figure 2:
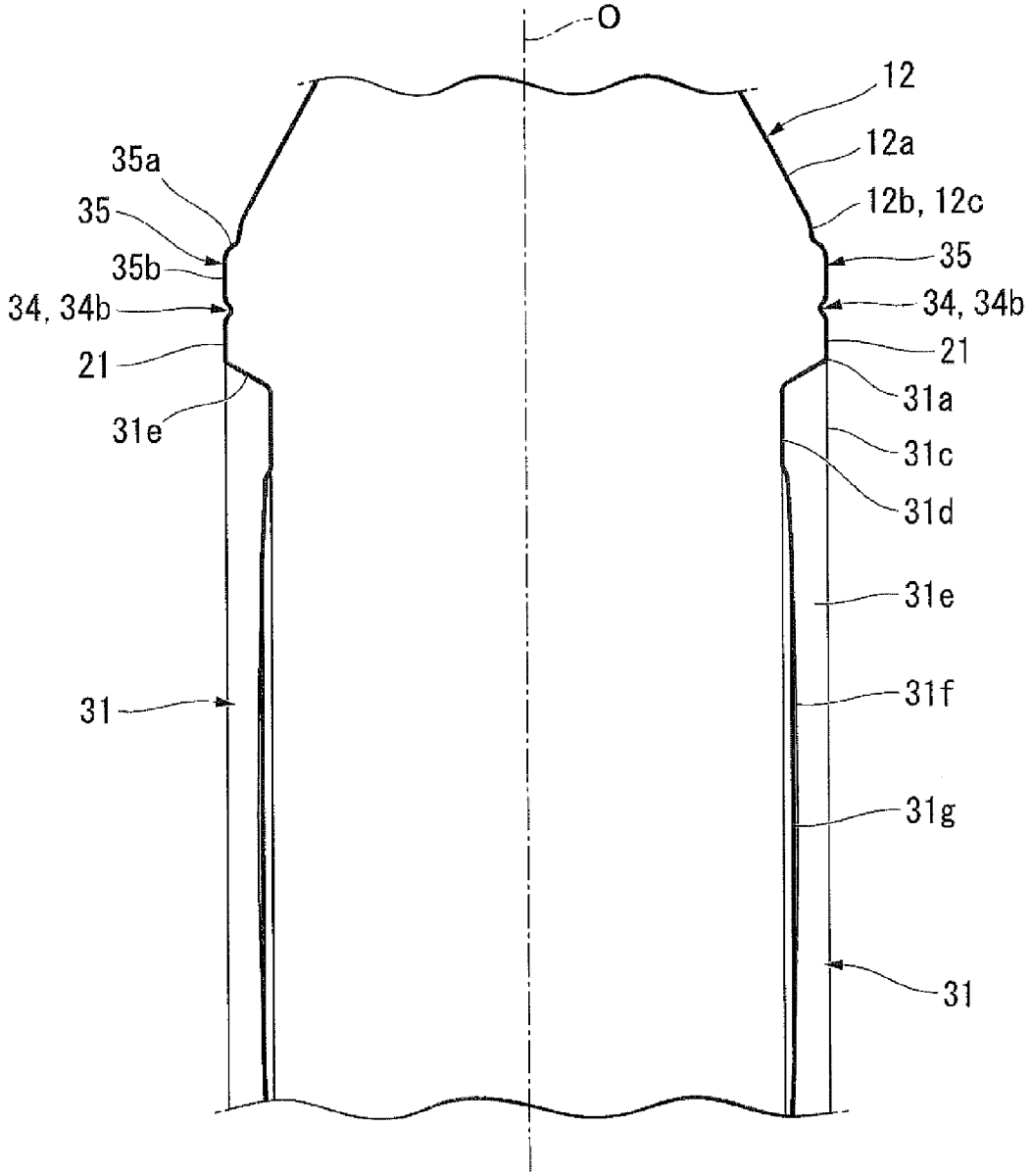
FIG. 2 is a cross-sectional view taken along line A-A of the polygonal bottle shown in FIG. 1.

As shown in FIG. 2, the panel bottom wall section 31*d* forms a linear shape when seen in a longitudinal cross-sectional view in the bottle axis O direction and extends substantially in parallel to the main wall section 21. The protrusion base section 31*f* is formed in a curved protruding surface shape gradually extending outward in the radial direction from the outside toward the inside in the bottle axis O direction.

In addition, as shown in FIG. 1, a lateral groove 32 extending in the circumferential direction and longitudinal grooves 33 that connects the panel section 31 and the lateral groove 32 in the bottle axis O direction are formed in a lower end portion of each of the main wall sections 21. Longitudinal grooves 33 are formed at intervals in the circumferential direction.

A length in the circumferential direction of the lateral groove 32 is equal to a length in the circumferential direction of the panel section 31. In addition, a central section in the circumferential direction of the lateral groove 32 and a central section in the circumferential direction of the main wall section 21 coincide with each other.

The longitudinal groove 33 forms a linear shape elongated in the bottle axis O direction when seen in the front view. A length in the bottle axis O direction of the longitudinal groove 33 is larger than a length in the bottle axis O direction of the lateral groove 32.

A recess amount recessed inward in the radial direction of the longitudinal groove 33 is smaller than a recess amount recessed inward in the radial direction of each of the panel section 31 and the lateral groove 32. The panel section 31, the longitudinal groove 33 and the lateral groove 32 are continued in the bottle axis O direction. Further, in the embodiment, although the panel section 31, the longitudinal groove 33 and the lateral groove 32 are sequentially continued from above to below in the bottle axis O direction, a gap may be provided therebetween.

In addition, in the main wall section 21, a surrounding groove 34 recessed inward in the radial direction is formed in an outer circumferential portion disposed farther outside than the panel section 31. The surrounding groove 34 forms an inverted U shape in a side view when seen in the radial direction (when seen in the front view), and in the outer circumferential portion of the main wall section 21, is integrally formed at a portion surrounding the above-mentioned panel section 31 from both sides in the circumferential direction and above.

In the example shown, the surrounding groove 34 includes a pair of longitudinal groove sections 34*a* extending in the bottle axis O direction and disposed at an interval in the circumferential direction, a lateral groove section 34*b* disposed over the longitudinal groove sections 34*a* and extending in the circumferential direction, and corner groove sections 34*c* that connects the pair of longitudinal groove sections 34*a* and the lateral groove section 34*b*. The longitudinal groove sections 34*a* are disposed at boundary portions between the main wall sections 21 and the connecting sections 22. The lateral groove section 34*b* is disposed at a boundary portion between the main wall sections 21 and the connecting sections 12*b* of the shoulder section 12.

Also, in the embodiment, a reinforcement protrusion 35 protruding outward in the radial direction is formed at a connecting portion 12*c* of the connecting section 12*b* to the main wall section 21 of the drum section 13. A central section in the circumferential direction of the reinforcement protrusion 35 and a central section in the circumferential direction of the main wall section 21 coincide with each other. In the surface of the reinforcement protrusion 35, a top surface 35*b* directed outward in the radial direction is continued to the outer circumferential surface of the drum section 13 with no step difference, and an upper surface 35*a* directed upward is formed in a curved surface shape protruding upward. The top surface 35*b* has a flat surface like the main wall section 21 of the drum section 13.

The upper surface 35*a* is disposed under an upper end of the connecting section 12*b*, and gradually extends downward from the inside toward the outside in the radial direction.

In addition, the upper surface 35*a* forms a single arc shape when seen in the front view, and both ends in the circumferential direction of the upper surface 35*a* are disposed at a boundary portion between the main wall section 21 and the connecting section 12*b*.

The reinforcement protrusion 35 is disposed further inside in the circumferential direction than both end portions in the circumferential direction of the main wall section 21. When seen in the front view, a radius of curvature of the top surface 35*b* is larger than a radius of curvature of each of the corner groove section 34*c* of the surrounding groove 34 and the corner edge portion 31*b* of the outer circumferential edge of the panel section 31.

In the example shown, an upper end of the upper surface 35*a* is disposed above the central section in the bottle axis O direction of the connecting section 12*b*. A lower end of the reinforcement protrusion 35 is disposed in the entire upper edge of the main wall section 21 except for both end portions in the circumferential direction.

In addition, both end portions in the circumferential direction of the reinforcement protrusion 35 are disposed farther outside in the circumferential direction than the panel section 31. Both end portions in the circumferential direction of the reinforcement protrusion 35 are disposed farther outside in the circumferential direction than the lateral groove section 34*b* in the surrounding groove 34 and disposed further inside in the circumferential direction than the pair of longitudinal groove sections 34*a*. That is, both end portions in the circumferential direction of the surrounding groove 34 are disposed farther outside in the circumferential direction than both end portions in the circumferential direction of the reinforcement protrusion 35.

As described above, according to the polygonal bottle 1 of the embodiment, the top surface 35*b* of the reinforcement protrusion 35 formed at the connecting section 12*b* serving as the connecting portion of the drum section 13 to the shoulder section 12 is continued to the outer circumferential surface of the drum section 13 with no step difference. For this reason, a compressive force applied to the upper end portion disposed over the panel section 31 in the main wall section 21 of the drum section 13 can also be received by the reinforcement protrusion 35, and it can be limited that a local large compressive force is applied to the upper end portion of the main wall section 21 of the drum section 13.

In addition, the upper surface 35*a* of the reinforcement protrusion 35 can serve as a rib with respect to the compressive force, and the upper surface 35*a* is formed in a curved surface shape protruding upward. Accordingly, an area of the top surface 35*b* of the reinforcement protrusion 35 can be widely secured, and the compressive force can be easily distributed in the circumferential direction.

Accordingly, generation of depression deformation from the upper end portion of the main wall section 21 of the drum section 13 to the shoulder section 12 by the compressive force applied to the upper end portion can be limited.

In addition, since both end portions in the circumferential direction of the reinforcement protrusion 35 are disposed farther outside in the circumferential direction than both end portions in the circumferential direction of the lateral edge portions 31*a*, generation of depression deformation from the upper end portion of the main wall section 21 of the drum section 13 to the shoulder section 12 by the compressive force applied to the upper end portion can be securely limited.

Further, since the surrounding groove 34 that surrounds the upper end portion of the panel section 31 is formed in the main wall section 21 of the drum section 13, the stiffness of the upper end portion in the main wall section 21 of the drum section 13 can be increased, and generation of depression deformation from the upper end portion to the shoulder section 12 by the compressive force applied to the upper end portion can be more securely limited.

Further, the technical scope of the present invention is not limited to the embodiment, and various modifications may be made without departing from the spirit of the present invention.

For example, in the embodiment, while the upper end of the upper surface 35*a* of the reinforcement protrusion 35 is disposed under the upper end of the connecting section 12*b*, the upper end is not limited to the above-mentioned aspect but may further protrude upward to be formed throughout the shoulder section main body 12*a* and the connecting section 12*b*. In addition, the shoulder section 12 may not include the connecting section 12*b*, and the shoulder section 12 may be formed by only the shoulder section main body 12*a*. In this case, a reinforcement protrusion is formed at a connecting portion of the drum section to the main wall section serving as a lower end portion of the shoulder section main body.

In addition, in the embodiment, while the upper surface 35*a* of the reinforcement protrusion 35 forms a single arc and has a curved surface shape protruding upward, the upper surface 35*a* is not limited to the above-mentioned aspect but may be formed in a curved surface shape protruding upward as a whole when seen in the front view by connecting a plurality of arcs in the circumferential direction.

In addition, in the embodiment, while the upper surface 35*a* of the reinforcement protrusion 35 shows a configuration inclined with respect to the radial direction, the upper surface is not limited to the above-mentioned aspect but may employ, for example, a configuration extending linearly in the radial direction.

Furthermore, the components of the above-mentioned embodiment can be appropriately substituted with known components without departing from the spirit of the present invention.

Next, a verification test of the above-mentioned effects will be described.

In the verification test, total four types of polygonal bottles of Examples 1 and 2 and Comparative Examples 1 and 2 were employed. The polygonal bottles each having an inner capacity of 265 ml (the entire height of 162 mm, a drum diameter of 53 mm, and a weight of 21 g) were employed.

In Example 1, the polygonal bottle 1 shown in FIG. 1 was employed, and in Example 2, a polygonal bottle in which a distance between an end portion in the circumferential direction of the reinforcement protrusion 35 and the corner groove section 34*c* of the surrounding groove 34 is reduced by 0.6 mm and the distance between the corner edge portion 31*b* of the panel section 31 and the corner groove section 34*c* of the surrounding groove 34 is reduced by 0.5 mm, in comparison with the polygonal bottle 1, was employed.

In addition, in Comparative Example 1, a polygonal bottle distinguished from the polygonal bottle of Example 2 in that the reinforcement protrusion is removed was employed. In Comparative Example 2, a polygonal bottle distinguished from the polygonal bottle of Comparative Example 1 in that a lateral groove extending in the circumferential direction is formed at a connecting portion of the shoulder section to the main wall section of the drum section was employed. The lateral groove was formed at a central section in the bottle axial direction of the connecting portion of the shoulder section and a size in the circumferential direction was equal to the size in the circumferential direction of the reinforcement protrusion.

In the verification test, in a state in which the bottles are filled with contents, when an end portion Op of one side in the circumferential direction of the upper end portion of the bottom wall section of the panel section is pressed inward in the radial direction by a distal end surface of a round bar having a diameter of 5 mm, a pressing force (strength) when the shoulder section is depressed and a pushing depth (displacement) by the round bar at this time were measured. The results are shown in Table 1.

TABLE 1

| | Comparative Example 1 | Comparative Example 2 | Example 1 | Example 2 |
|---|---|---|---|---|
| Strength (N) | 20.2 | 22.3 | 30.7 | 26.5 |
| Displacement (mm) | 2.8 | 3.2 | 4.4 | 3.9 |

As shown in Table 1, it was confirmed that the strength and the displacement when the shoulder section is depressed are highest in the polygonal bottle according to Example 1 and lowest in the polygonal bottle according to Comparative Example 1.

Accordingly, it was confirmed that generation of depression deformation from the upper end portion of the main wall section of the drum section to the shoulder section can be limited by forming the reinforcement protrusion.

What is claimed is:

1. A polygonal bottle having a mouth section, a shoulder section, a drum section and a bottom section that are sequentially and continuously formed in a bottle axial direction and integrally formed of a synthetic resin material, the drum section including a plurality of main wall sections connected via connecting sections in a circumferential direction about a bottle axis such that, in a lateral cross sectional view perpendicular to the bottle axis, a polygonal shape is formed, and in which a panel section recessed inward in a radial direction, extending in the bottle axial direction and arriving at an upper portion of the mouth section side of the main wall section is formed at the main wall sections of the drum section, wherein a reinforcement protrusion protruding outward in the radial direction is formed at connecting portions of the shoulder section to the main wall sections of the drum section, among surfaces of the reinforcement protrusion, a top surface directed outward in the radial direction is a flat surface continued to an outer circumferential surface of the drum section with no step difference, and an upper surface directed upward is formed in a curved surface shape protruding upward.

2. The polygonal bottle according to claim 1, wherein the panel section is formed in a rectangular shape extending in the bottle axial direction in a front view when seen from the outside of the bottle in the radial direction, in the front view, an outer circumferential edge of the panel section includes a pair of lateral edge portions extending in the circumferential direction and disposed at an interval in the bottle axial direction, a pair of vertical edge portions extending in the bottle axial direction and disposed at an interval in the circumferential direction, and corner edge portions that connect the lateral edge portions and the vertical edge portions and form a curved line protruding outward, and both end portions in the circumferential direction of the reinforcement protrusion are disposed farther outside in the circumferential direction than both end portions in the circumferential direction of the lateral edge portions.

3. A polygonal bottle having a mouth section, a shoulder section, a drum section and a bottom section that are sequentially and continuously formed in a bottle axial direction and integrally formed of a synthetic resin material, the drum section including a plurality of main wall sections connected via connecting sections in a circumferential direction about a bottle axis such that, in a lateral cross sectional view perpendicular to the bottle axis, a polygonal shape is formed, and in which a panel section recessed inward in a radial direction, extending in the bottle axial direction and arriving at an upper portion of the mouth section side of the main wall section is formed at the main wall sections of the drum section, wherein a reinforcement protrusion protruding outward in the radial direction is formed at connecting portions of the shoulder section to the main wall sections of the drum section, among surfaces of the reinforcement protrusion, a top surface directed outward in the radial direction is continued to an outer circumferential surface of the drum section with no step difference, an upper surface directed upward is formed in a curved surface shape protruding upward, and a surrounding groove that surrounds an upper end portion of the panel section is formed at the main wall section of the drum section, and both end portions in the circumferential direction of the surrounding groove are disposed farther outside in the circumferential direction than both end portions in the circumferential direction of the reinforcement protrusion.

4. A polygonal bottle having a mouth section, a shoulder section, a drum section and a bottom section that are sequentially and continuously formed in a bottle axial direction and integrally formed of a synthetic resin material, the drum section including a plurality of main wall sections connected via connecting sections in a circumferential direction about a bottle axis such that, in a lateral cross sectional view perpendicular to the bottle axis, a polygonal shape is formed, and in which a panel section recessed inward in a radial direction, extending in the bottle axial direction and arriving at an upper portion of the mouth section side of the main wall section is formed at the main wall sections of the drum section, wherein a reinforcement protrusion protruding outward in the radial direction is formed at connecting portions of the shoulder section to the main wall sections of the drum section, among surfaces of the reinforcement protrusion, a top surface directed outward in the radial direction is continued to an outer circumferential surface of the drum section with no step difference, an upper surface directed upward is formed in a curved surface shape protruding upward, the panel section is formed in a rectangular shape extending in the bottle axial direction in a front view when seen from the outside of the bottle in the radial direction, in the front view, an outer circumferential edge of the panel section includes a pair of lateral edge portions extending in the circumferential direction and disposed at an interval in the bottle axial direction, a pair of vertical edge portions extending in the bottle axial direction and disposed at an interval in the circumferential direction, and corner edge portions that connect the lateral edge portions and the vertical edge portions and form a curved line protruding outward, both end portions in the circumferential direction of the reinforcement protrusion are disposed farther outside in the circumferential direction than both end portions in the circumferential direction of the lateral edge portions, and a surrounding groove that surrounds an upper end portion of the panel section is formed at the main wall section of the drum section, and both end portions in the circumferential direction of the surrounding groove are disposed farther outside in the circumferential direction than both end portions in the circumferential direction of the reinforcement protrusion.

* * * * *